US005225059A

United States Patent [19]

Penrose

[11] Patent Number: 5,225,059

[45] Date of Patent: Jul. 6, 1993

[54] APPARATUS FOR SINGLE ANODE BRUSH ELECTROPLATING

[75] Inventor: Robert Penrose, Solana Beach, Calif.

[73] Assignee: W. R. Associates, Solan Beach, Calif.

[21] Appl. No.: 924,862

[22] Filed: Aug. 3, 1992

[51] Int. Cl.[5] ..... C25D 17/14; C25D 17/00; C25D 21/00

[52] U.S. Cl. ..... 204/212; 204/218; 204/224 R; 204/228; 204/271; 204/275

[58] Field of Search ..... 204/212, 224 R, 228, 204/271, 275, 218

[56] References Cited

U.S. PATENT DOCUMENTS

| | | | |
|---|---|---|---|
| 2,540,602 | 2/1951 | Thomas et al. | 204/224 R UX |
| 2,750,332 | 6/1956 | Miller | 204/224 R |
| 2,961,395 | 11/1960 | Icxi | 204/224 R |
| 3,637,468 | 1/1972 | Icxi et al. | 204/271 X |
| 3,779,887 | 12/1973 | Gildone | 204/271 X |
| 4,879,015 | 11/1989 | Adamek et al. | 204/224 R |
| 4,890,727 | 1/1990 | Downing et al. | 204/224 R |

*Primary Examiner*—Donald R. Valentine
*Attorney, Agent, or Firm*—Frank D. Gilliam

[57] ABSTRACT

An apparatus for electroplating conductive surfaces, in particular rotatable surfaces. A hand held anode includes a porous surface material such as polypropylene wool, backed by an inert anode mounted on a handle and connected to a source of direct current. A delivery tube through the anode handle allows liquid to be delivered to the surface material. A manually actuatable valve system on the anode handle permits liquids from a selected one of plural supply tubes to be connected to the delivery tube. In operation, the anode is connected to a positive polarity direct current sources, a plating liquid is directed from a supply to the valve system, then to the anode surface material through the delivery tube. Depending on the direct current polarity selected and the liquid selected for delivery to the anode material, the workpiece surface may be cleaned, treated or plated. A series of movable trays are positioned below the workpiece to catch liquid that may drip from the anode surface material. This system permits the rapid and convenient electroplating of selected areas on a workpiece without contamination between different process liquids.

9 Claims, 1 Drawing Sheet

APPARATUS FOR SINGLE ANODE BRUSH ELECTROPLATING

BACKGROUND OF THE INVENTION

This invention relates in general to electroplating metals on a conductive substrate and, more particularly, to an apparatus for brush plating of workpieces.

Forming metal layers on conductive substrates has long been accomplished by electroplating. In conventional electroplating, the object to be plated (the cathode) and an anode are suspended in an electrolyte that contains salts of the metal to be deposited and often other chemicals to assist in the electrochemical action. The anode is connected to the positive pole of a direct current source, such as a battery, and the object or cathode is connected to the negative pole. The anode may be formed from the metal being plated or from an inert conductor, such as platinum. Metal from the electrolyte is deposited in a uniform coating on the object being plated. If the anode is inert, the electrolyte must be regularly replenished with the metal being deposited.

Electroplating is used for many purposes, such as the plating protective, hard, metal surfaces on softer metal substrates, the production of jewelry by plating precious metals on base metal substrates and the repair of worn metal objects, such as bearings and the like, by deposition additional metal in worn areas.

In some cases it is necessary to plate portions of objects that are too large to be conveniently placed entirely in a plating bath, or where only a small portion of the object is to be plated. Typically, a bearing on a long rotating shaft, bearing journals on electric motor shafts and the like require repair when worn to the point where excessive play and vibration occurs between the shaft and bearing. Often the diameter of the shaft has worn to the point that it is 0.0005 to 0.002 inch undersize, so that electroplating of a uniform thin, adherent layer of the shaft metal around the shaft is necessary.

Brush plating was developed to permit such localized plating. In its simplest form, brush plating can be accomplished with an ordinary paint brush, with a small piece of metal adjacent to one side of the bristles to act as the anode. The brush anode and the object to be plated are connected to a direct current source, the brush is dipped in the electrolyte and the brush is moved across the surface to be plated. With repeated dipping and brushing, an electroplated layer will be built up on the object surface.

While effective with small areas and limited thickness plating, this prior art system of brush plating has a number of problems. Cleaning of the object to be plated must be done separately. Electrocleaning, where a reverse current and an electrolyte is used to remove a small amount of metal from the object surface, is difficult to accomplish and will often contaminate the brush. Plating is very slow, with the need to constantly dip the brush in the electrolyte. In some cases, a squirt bottle can be used to replenish the brush electrolyte. The brush and squirt bottle, if used, will tend to drip or splatter electrolyte, especially where a slowly rotating shaft surface is to be plated. Some of the plating solutions are quite costly, so wasted solution can be a considerable expense. Where cleaning solutions and various activator etchant solutions are used to obtain improved plating, the process must stop between steps to allow the object to be rinsed with water to remove the previous solution and prevent contamination. Either different brushes must be used for the different solutions or a single brush must be cleaned carefully between solutions.

While brush plating has applications in some small, light plating, applications, these problems prevent brush plating from being effectively used in the repair of structural objects where high quality plating to uniform thicknesses without contamination on a rapid, production line basis is required.

Thus, there is a continuing need for improved brush plating systems allowing rapid plating to relatively thick layers on a rapid basis while avoiding contamination between different solutions used in the plating operation.

SUMMARY OF THE INVENTION

It is, therefore, an object of this invention to provide a brush plating apparatus overcoming the above-noted problems. Another object is to provide a brush plating apparatus capable of plating at a continuous rate to relatively thick layers. A further object is to provide an apparatus that permits rapid change between solutions used in brush plating without contamination between solutions. Yet another object is to provide an apparatus that saves excess valuable solutions without contamination. Still another object is to provide an apparatus having a brush anode capable of covering and plating a considerable area of a rotating object.

The above objects, and others, are accomplished in accordance with this invention by a brush plating system that comprises a hand held anode assembly, a system for selectively directing a selected plating liquid to the anode and a selective tray arrangement for catching excess plating liquids.

The anode assembly is mounted on a handle and connected to a source of direct current. The anode assembly includes an inert conductive anode, typically platinum plated niobium, mounted on an anode handle, a porous material coverinq the anode and adapted to be brought into physical contact with the object to be plated, a delivery tube for delivering a plating solution to the porous material and a valve system mounted on the anode handle for connecting any one of a plurality of supply tubes to the delivery tube.

A plurality of supply tanks are provided to hold the electrolyte, an electrocleaning solution, various activator or etchant solutions and the like. A supply tube connects each of the tanks to the valve system on the anode handle. Any suitable means, such as pressurized tanks or pumps at the tanks, is provided to cause the tank liquids to flow to the valve system.

A support is provide for the object to be plated. Where the object is cylindrical and is preferably rotated during plating, provision may be made for a low speed motor for rotating the object during plating.

A tray assembly is provided below the object support to catch overflow or other drips from the anode. Different trays may be moved into place to catch each solution for use. In some cases, only the electrolyte is of sufficient value to require saving in an uncontaminated state. In that case, one tray will be positioned to catch electrolyte overflow and a second tray will be positioned during all other steps to catch all other solutions, which are then disposed of in a proper manner.

BRIEF DESCRIPTION OF THE DRAWING

Details of the invention, and of certain preferred embodiments thereof, will be further understood upon reference to the drawing, wherein.

DETAILED DESCRIPTION OF PREFERRED EMBODIMENTS

Figure 1:
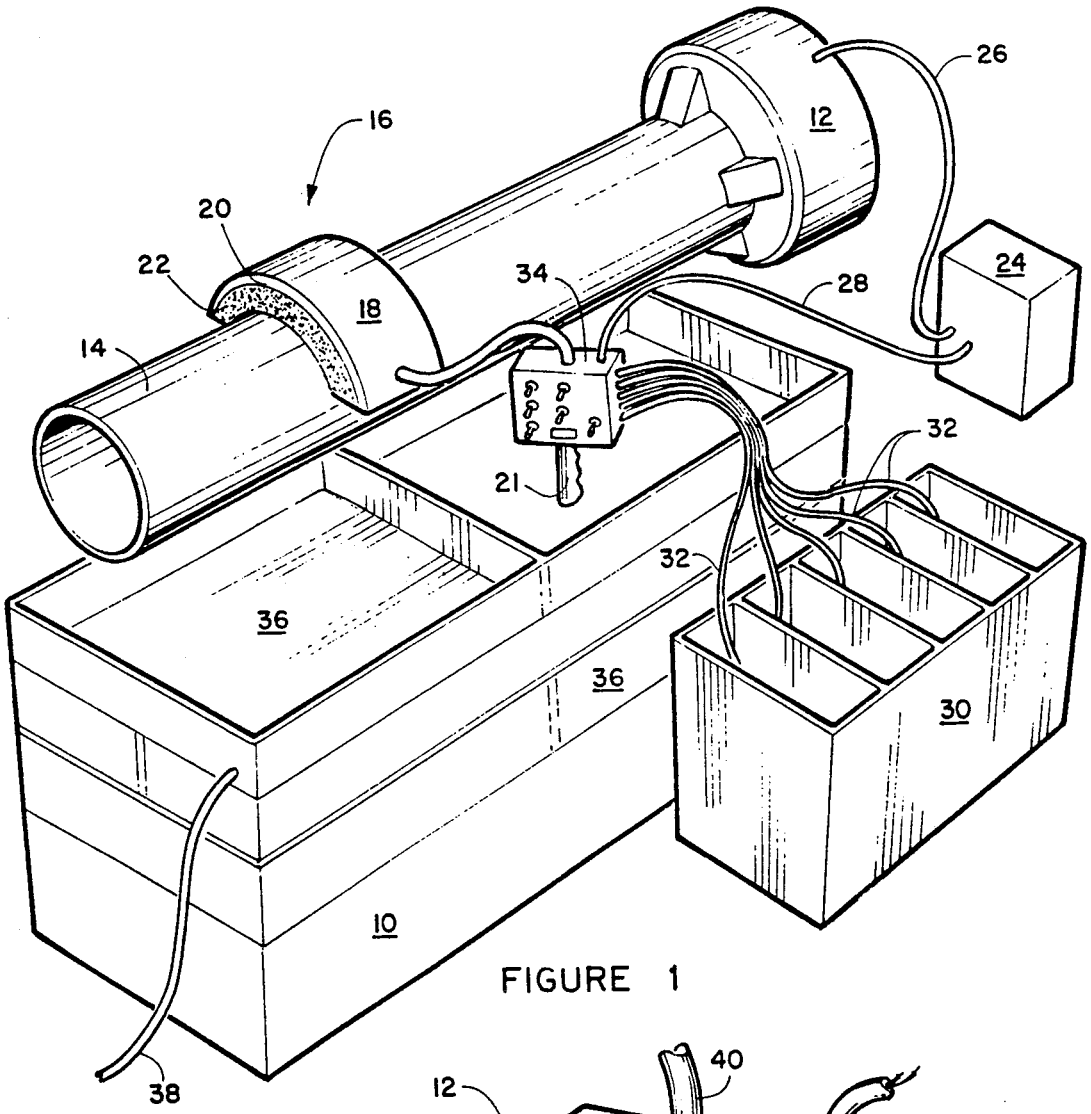
FIG. 1 is a schematic perspective view of the brush electroplating apparatus of this invention.

Referring now to FIG. 1, there is seen a base 10 upon which a rotatable support 12 is mounted. Support 12 may be any conventional chuck or collet capable of holding a generally cylindrical object 14 to be plated. While the plating of objects that are surfaces of revolution, while they are being rotated, is the preferred application for the apparatus of this invention, objects having other shapes could also be plated, if desired.

A hand-held anode assembly 16 is adapted to be held adjacent to object 14. Anode assembly 16 includes a curved backing 18 typically formed from plastic, having a conductive anode surface 20 on the inside, mounted on a handle 21. While any inert anode may be used, a platinum plated, reasonably inert, metal is preferred, such as platinum plated niobium. A sheet of porous material 22 is provided over anode 20 and is shaped to conform to the exterior of object 14. Any suitable chemically inert, electrically insulating, non-absorptive material which is easily rinsed clean may be used for porous material 22. Typical materials include fiber matts, soft open cell foam and the like. For optimum results, I prefer polypropylene wool, of the sort that is available from Liquid Development Company, Cleveland, Ohio.

A conventional direct current power supply 24 is connected through a ground cable 26 to rotatable support 12 and object 14 and through a cable 28 running through handle 21 to anode 20. Depending on the size of the anode and object being plated, power supply 24 may provide from 15 volt, 10 amp to 25 volt, 500 amp current. Such power supplies are available under the M 15-20-115-1C and M 500-25-460-3C model numbers from the Liquid Development Company.

The various liquids used during the cleaning and plating operations are delivered from a series of conventional tanks 30 through plural tubes 32 to a valve assembly 34 (described in detail in conjunction with the description of FIG. 2) on anode handle 21. Each tube 32 may extend below the liquid surface in its respective tank and the air volume above the liquid levels in the tanks may be pressurized by an air pump, so that the liquids will be supplied to valve assembly 34 under pressure.

Since some of the liquids will be consumed during use, in particular the plating electrolyte, a constant flow of each liquid is desirable during application of that liquid. Excess liquid will run down and drip into a selected one of plural trays 36 movable to positions below anode assembly 16. Each tray 36 is slidable from a stacked storage location below rotatable support 12 to a position below anode assembly 16. In many cases, only two trays 36 will be needed, one to catch the high value plating electrolyte and one to catch all of the lower value cleaning and activation liquids for disposal. A drain line 38 may be provided on the cleaning solution tray. Of course, additional trays may be provided in a stack with cooperating slides so that different trays can be moved into position to catch different process liquids as desired.

Figure 2:
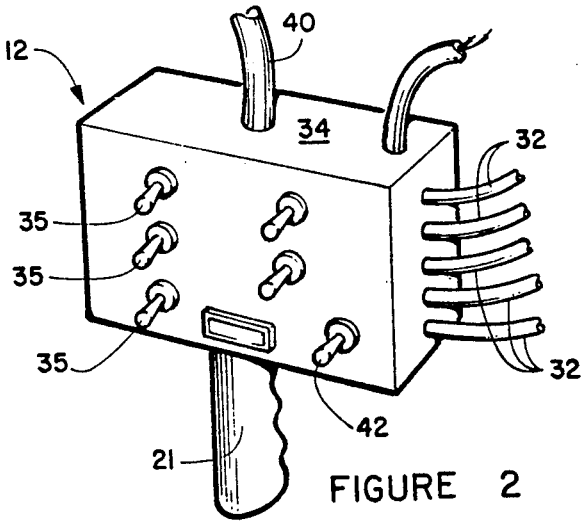
FIG. 2 is a schematic perspective view of the anode handle mounted valve and system control panel.

A schematic representation of the control box including valve assembly 34 for the various liquids entering through tubes 32 is provided in FIG. 2. Valve assembly 34 is mounted on anode handle 21. Valves 35 selectively connect any one of supply tubes 32 to delivery tube 40 that directs the selected liquid to porous material 22 for application to object 14. Preferably, water rinse valve 37 has a larger and more apparent push button, since the water rinse will be used more often. A conventional three-position electric switch 42 may be provided with valve assembly 34 to reverse polarity of the direct current applied to anode 20 between the electroclean and plating operations. The switch has three positions; "off", "positive" and "negative". In that case, cable 28 will include two separate wires carrying both positive and negative polarity to switch 42. Switch 42 may also, if desired, be directly mounted on power supply 24. Valves 35 are preferably conventional solenoid valves using self cleaning mechanical plastic valves components and no metal in contact with the liquids. Suitable valves include ⅛ in. minivalves available from Hardie Irrigation Co. under the I7024N24V designation. Valve 37, for greater flow, may be a polyvinyl chloride ball valve available from McMaster Carr under the 4506K17 designation.

A typical sequence of operation of this apparatus is as follows. The object 14 to be plated is put in the rotatable support 12. Ground cable 26 is connected to support 12 and anode cable 28 is connected to anode 20 through handle 21 and switch 42 (if used). Rotation of the object is begun. A catch tray 36 is positioned below the area to be plated.

The valve to the electrocleaning solution is turned on with the power supply switch 42 providing negative polarity to anode 20. Any suitable electrocleaning solutions may be used. A typical simple electrocleaning solution for steel comprises about 8 ounces of sodium hydroxide and about 2 ounces of laundry soap chips per gallon of water. Suitable cleaning solutions are available from the Liquid Development Company (LDC) under the LDC Electroclean designation.

When sufficient cleaning has been accomplished, the cleaning solution valve is closed and the rinse water valve is turned on for a time sufficient to flush the cleaning solution from the anode porous material 22. Current of negative polarity is provided to the anode switch 42 and the valve to the first activator supply is turned on. This activator typically contains water, sodium chloride and hydrochloric acid. A suitable activator is LDC Activator #2. When the color of the surface of object 14 is uniformly dark grey, the activator valve is turned off and the rinse water valve is turned on to rinse porous material 22.

The valve for the second activator solution is then turned on. The second activator solution typically contains water, sodium hydrochloride and citric acid. A suitable second activator is LDC Activator #3. When the surface of object 14 is uniformly light grey, the activator valve is closed and the rinse water valve is opened for a period sufficient to rinse porous material 22. In many cases all of these solutions and rinse water will be caught in a single tray 36 for disposal. If desired, selected ones of stacked trays 36 may be moved into place to catch each solution separately.

The power supply 24 is adjusted for the selected plating parameters. A second catch tray 36 is moved into position below the plating area. The valve to the plating solution is then turned on and positive current is supplied to the anode. Any suitable plating solution, such as LDC Nickel High Build, may be used. After the desired plating is accomplished, often judged by recording amp hours during plating, the plating solution valve is turned off, the power supply is turned off, the rinse valve is turned on for a sufficient time to rinse porous material 22 and object 14 and the object is removed from the assembly.

Additional valves and supply tanks are provided beyond those used in this exemplary description of typical operation of the apparatus for the cases where plating of more than one metal may be desired, or other treating steps may be used.

Other applications, variations and ramifications of this invention will occur to those skilled in the art upon reading this disclosure. Those are intended to be included within the scope of this invention, as defined in the appended claims.

I claim:

1. An apparatus for electroplating conductive surfaces which comprises:

support means for supporting an object to be plated;

an anode;

a layer of porous material on said anode;

said anode mounted on a handle for manual manipulation of said anode;

a delivery tube for delivering liquid to said porous material;

a plurality of supply tanks each having a supply tube;

a plurality of valves mounted on said handle, each of said valves connected to an individual supply tube and to said delivery tube to selectively direct liquid from the selected individual supply tube to said delivery tube; and a power supply for providing direct current to said anode.

2. The apparatus according to claim 1 further including a plurality of catch trays selectively positionable below said object.

3. The apparatus according to claim 2 including means for stacking said trays below said support means and including means for selectively sliding trays to a position below the areas of said object to be plated.

4. The apparatus according to claim 1 wherein said support means includes means for rotating an object that is a surface of revolution, and said anode is shaped to substantially conform to the surface of said object.

5. The apparatus according to claim 1 further including switch means for reversing the polarity of direct current supplied to said anode.

6. The apparatus according to claim 1 wherein said porous material is polypropylene wool.

7. An anode assembly for use in brush-type electroplating which comprises:

an anode;

a layer of porous material on said anode;

said anode mounted on a handle for manual manipulation of said anode;

a delivery tube for delivering liquid to said porous material;

a plurality of supply tubes for delivering liquids to said porous material; and a plurality of manually actuatable valves mounted on said handle, each of said valves connected to an individual supply tube and to said delivery tube to selectively direct liquid from the associated individual supply tube to said delivery tube.

8. The apparatus according to claim 7 further including electrical cable means connected to said anode for conducting positive and negative direct current to said anode and switch means in said cable on said handle for selecting the polarity of direct current supplied to said anode.

9. The apparatus according to claim 7 wherein said porous material is polypropylene wool.

* * * * *